United States Patent [19]

Hanada et al.

[11] 4,454,728

[45] Jun. 19, 1984

[54] AIR CONDITIONING SYSTEM

[75] Inventors: Masamichi Hanada, Shimizu; Hirokiyo Terada, Shizuoka, both of Japan

[73] Assignee: Hitachi, Ltd., Tokyo, Japan

[21] Appl. No.: 457,270

[22] Filed: Jan. 11, 1983

[30] Foreign Application Priority Data

Feb. 3, 1982 [JP] Japan ..... 57-14957

[51] Int. Cl.[3] ..... F25B 7/00

[52] U.S. Cl. ..... 62/324.1; 62/335; 237/2 B

[58] Field of Search ..... 237/2 B, 335; 165/29; 62/175, 185, 335, 510, 324.1

[56] References Cited

U.S. PATENT DOCUMENTS

| | | | |
|---|---|---|---|
| 2,241,060 | 5/1941 | Gibson | 237/2 B |
| 3,277,668 | 10/1966 | Foster | 62/185 X |
| 3,411,571 | 11/1968 | Lawernce | 165/107 |
| 3,523,575 | 8/1970 | Olivieri | 165/22 |
| 3,808,827 | 5/1974 | Avon et al. | 62/59 |
| 3,922,876 | 12/1975 | Wetherington, Jr. et al. | 62/180 |
| 4,077,464 | 3/1978 | Moog | 165/18 |
| 4,123,003 | 10/1978 | Winston | 237/2 B |
| 4,242,873 | 1/1981 | Hino | 62/2 |
| 4,248,049 | 2/1981 | Briley | 62/2 |

FOREIGN PATENT DOCUMENTS 49-83654 7/1974 Japan .

*Primary Examiner*—William E. Wayner

*Assistant Examiner*—J. Sollecito

*Attorney, Agent, or Firm*—Antonelli, Terry & Wands

[57] ABSTRACT

An air conditioning system including at least one water-cooling type air conditioning unit, a heat pump chilling unit, an ancillary heat exchanger in said water-cooling type air conditioning unit, and a cold and heat accumulating tank divided into two tank sections differing from each other in volume and the temperature of water contained therein. In a cooling mode, cold water of relatively high temperature and cold water of relatively low temperature are accumulated by operating the heat pump chilling unit at night, and when a normal heating operation is performed, the cold water of relatively high temperature is used as cooling water for a condenser of the water-cooling type air conditioning unit and when the water-cooling type air conditioning unit is inoperable as when power failure occurs at peak load, the cold water of relatively low temperature is supplied to the ancillary heat exchanger to carry out cooling. In a heating mode, warm water of relatively high temperature and warm water of relatively low temperature are accumulated by operating the heat pump chilling unit at night, and at startup in a heating operation, the warm water of relatively high temperature is supplied to the ancillary heat exchanger to start the heating operation, and in a normal heating operation, the warm water of relatively low temperature is directly used as a heat source water for a water side heat exchanger of the air conditioning unit or as a heating heat source.

22 Claims, 3 Drawing Figures

AIR CONDITIONING SYSTEM

BACKGROUND OF THE INVENTION

This invention relates to an air conditioning system comprising at least one water-cooling type air conditioning unit, a heat pump chilling unit and a cold and heat accumulating tank.

Heretofore, a water-cooling type or air-cooling type heat pump air conditioning unit has been in use in many applications to effect space cooling and space heating with increased efficiency. Generally, an air conditioning unit is operated for a longer period of time in the daytime than at night, and demand for electric power shows a marked increased when space cooling is effected in the daytime in summer, so that it sometimes happens that the supply of electric power is unable to meet the demand and a power failure might occur. When such situation takes place, the water-cooling type or air-cooling type heat pump air conditioning unit is unable, when used singly, to cope with the power failure at peak load. When space heating is performed by the air conditioning unit of the aforesaid type, the air conditioning unit usually has a heating load rate in the daytime which is about 50–70% of the maximum load rate early in the morning, so that an air conditioning unit should have an unreasonably high capacity if it is desired to meet all the load requirements with a single unit. This would be economically disadvantageous. To cope with this situation, the use of a heat accumulating tank has been proposed as means for operating the air conditioning unit economically with increased efficiency.

An air conditioning unit using a heat accumulating tank is disclosed, for example, in U.S. Pat. Nos. 3,411,571, 3,523,575, 3,808,827, 3,922,876, 4,077,464 and 4,242,873 and Japanese Utility Model Application Laid-Open No. 83654/74.

In the above mentioned Japanese Utility Model Application Laid-Open No. 83654/74, a chilling unit (water-to-water heat pump) and an air heating source heat pump are connected to the heat accumulating tank through a water line. This prior art arrangement is intended to provide a system capable of operating with a high degree of efficiency in effecting space heating and space cooling by using the same pressure ratio of the compressor of the air heating source heat pump under the two conditions of heating and cooling. However, no measures have been taken to cope with an interruption of power supply when space cooling is effected at peak load or an application of a high load when space heating is effected.

SUMMARY OF THE INVENTION

This invention has been developed for the purpose of obviating the aforesaid disadvantages of the prior art. Accordingly an object of the invention is to provide an air conditioning system which utilizes cold water that has been accumulated to economize on the electric power used and cope with an interruption of power supply at peak load.

Another object is to provide an air conditioning system enabling space heating, particularly at maximum load in the early morning, to be effected with efficiency.

Still another object is to provide an air conditioning system enabling an overall compact size to be obtained in equipment used.

A further object is to provide an air conditioning system enabling consumption of electric power to be averaged out through night and day.

In accordance with advantageous features the present invention an air conditioning system is provided which includes a cold and heat accumulating tank divided into two tank sections differing from each other in volume and the temperature of the cold and heat accumulated, with an ancillary heat exchanger being provided as a heat exchanger of the utilization side. When space cooling is carried out, cold water of relatively high temperature is accumulated in the cold and heat accumulating tank section of larger volume by actuating a change-over valve mounted in a water line connecting the air conditioning unit to the chilling unit and cold water of relatively low temperature is accumulated in the cold and heat accumulating tank section of smaller volume by actuating a change-over valve mounted in another water line connecting the air conditioning unit to the chilling unit. In a normal space cooling operation, the cold water of relatively high temperature in the cold and heat accumulating tank section of larger volume is fed as a cooling water for the condenser of the water-cooling type air conditioning unit by actuating another change-over valve mounted in a water line. When the water-cooling type air conditioning unit is rendered inoperative due to a failure of power supply or to reduce power consumption, the cold water of relatively low temperature is fed from the cold and heat accumulating tank section of smaller volume to an ancillary heat exchanger by actuating another change-over valve mounted in a water line. When space heating is carried out, water of relatively low temperature is accumulated in the cold and heat accumulating tank section of larger volume by actuating the change-over valve mounted in the water line connecting the chilling unit to the air conditioning unit and warm water of relatively high temperature is accumulated in the cold and heat accumulating tank section of smaller volume by actuating the change-over valve mounted in the water line connecting the air conditioning unit to the chilling unit. In the initiating stages of space heating operation, the warm water of relatively high temperature in the cold and heat accumulating tank section of smaller volume is fed to the ancillary heat exchanger by actuating another change-over valve mounted in a water line connecting the air conditioning unit to the ancillary heat exchanger, and, in the normal space heating operation, the cold water of relatively low temperature in the cold and heat accumulating tank of larger volume is fed to an evaporator of the water-cooling type air conditioning unit as a heat source water by actuating another change-over valve mounted in a water line or the warm water in the chilling unit is directly fed to the ancillary heat exchanger of the water-cooling type air conditioning unit.

Stated differently, according to the invention, there is provided an air conditioning system wherein the cold and heat accumulating tank is divided into two tank sections differing in volume and the temperature of the cold and heat accumulated therein, and when space cooling is carried out, the cold water cooled by the cold and heat accumulating tank section of smaller volume is accumulated by the heat pump type chilling unit while cold water of relatively high temperature is accumulated in the cold and heat accumulating tank section of larger volume, so that in normal space cooling operation, the cold water of relatively high temperature in the cold and heat accumulating tank section of larger volume is used as cooling water for the condenser of the water-cooling type air conditioning unit to enable the latter to function as a cooling unit. When the water-cooling type air conditioning unit is rendered inoperative by a failure of power supply, only a blower is operated and a compressor of the water-cooling type air conditioning unit is shut down so as to continue cooling operation by utilizing the cold water cooled by the cold and heat accumulating tank section of smaller volume. In space heating operation, the warm water heated at the cold and heat accumulating tank section of smaller volume is accumulated in the chilling unit of the heat pump type and warm water of relatively low temperature is accumulated in the cold and heat accumulating tank section of larger volume. The warm water of high temperature in the cold and heat accumulating tank section of smaller volume is utilized, when a large amount of heat is required, as when space heating is initiated, early in the morning, to start space heating, and the water of relatively low temperature in the cold and heat accumulating tank section of larger volume is utilized in normal space heating operation to enable space heating to be performed by the water-cooling type air conditioning unit. The heat accumulated in the tank section of smaller volume is utilized at maximum load as aforesaid, so that the need to increase the capacities of the equipment to match the maximum load is eliminated and the capacities of the equipment can be reduced. Since cold and heat accumulation can be effected at night by utilizing the chilling unit of the heat pump type, it is possible to average out the consumption of electric power through day and night, thereby enabling the system to be economically operated.

DETAILED DESCRIPTION OF THE PREFERRED EMBODIMENTS

Figure 1:
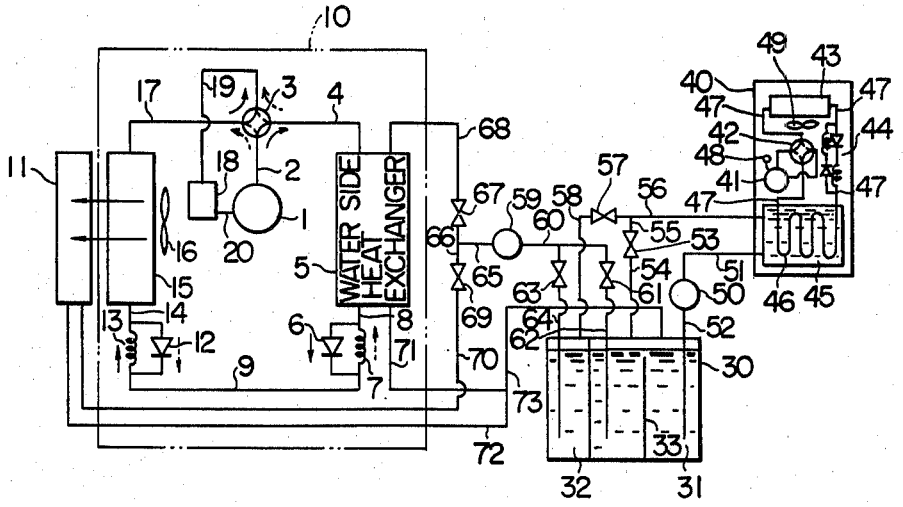
FIG. 1 is a schematic view of the piping of the air conditioning system comprising one embodiment of the invention.

Referring now to the drawings wherein like reference numerals are used throughout the various views to designate like parts and, more particularly, to FIG. 1, according to this figure, an air conditioning system in conformity with the invention comprises a water-cooling type heat pump air conditioning unit 10, an ancillary heat exchanger 11, a cold and heat accumulating tank 30 and a heat pump chilling unit 40 connected together by lines mounting a plurality of change-over valves and pumps. The water-cooling type heat pump air conditioning unit 10 comprises a four-way change-over valve 3 mounted in a refrigerant discharge line 2 of a compressor 1 for switching a refrigerant circuit and having one connecting port connected to a water side heat exchanger 5 through a line 4. A check valve 6 allows a refrigerant to flow therethrough in a cooling mode but prevents the same from flowing therethrough in a heating mode. A pressure reducing means 7, only actuated in a heating mode, is connected in parallel with the check valve 6 and connected to the water side heat exchanger 5 through a line 8 in heat exchange relationship. Another line 9 is connected to a parallel circuit of another check valve 12 and another pressure reducing means 13. The check valve 12 allows the refrigerant to flow therethrough in a heating mode but prevents the same from flowing therethrough in a cooling mode and the pressure reducing means 13 allows the refrigerant to flow therethrough in a cooling mode to cause same to expand by reducing pressure to thereby perform a cooling operation. The check valve 12 and pressure reducing means 13 are connected to a utilization side heat exchanger 15 through a line 14. The utilization side heat exchanger 15 is a heat exchanger of the type allowing the refrigerant to exchange heat with air and cooling or heating air forcibly fed by a blower 16. A line 17 connected at one end to the utilization side heat exchanger 15 is connected at the other end to another connection port of the four-way change-over valve 3. A accumulator 18 is connected at its inlet to the four-way change-over valve 3 through a line 19 and at its outlet to a suction side of the compressor 1 through a line 20. The cold and heat accumulating tank 30 is divided into a tank section 31 of larger volume and a tank section 32 of smaller volume. The tank section 31 of larger volume is further divided by a partition wall 33 allowing an overflow to take place.

The heat pump chilling unit 40 comprises a compressor 41, a four-way change-over valve 42, a heat source side heat exchanger 43, circuits 44 of a check valve for cooling and pressure reducing means and a check valve for heating and pressure reducing means, respectively, and a refrigerant passage 46 arranged in a water side heat exchanger 45 in heat exchange relationship connected through a line 47 in series with the circuits 44 and the change-over valve 42 to thereby constitute a heat pump refrigeration cycle. A timer 48 controls the operation of a blower 49. A first pump 50 is connected at its outlet to the water side heat exchanger 45 through a line 51 and at its inlet to the tank section 31 of larger volume through a line 52. A first change-over valve 53 is connected at its outlet to the tank section 31 of larger volume through a line 54 and at its inlet to a line 56 connected to an outlet of the water side heat exchanger 45 through a line 55. A second change-over valve 57 is connected at its inlet to the line 56 and at its outlet to the tank section 32 of smaller volume through a line 58. A second pump 59 is connected at its inlet to a third change-over valve 61 through a line 60, with the third change-over valve 61 being connected through a line 62 to the tank section 31 of larger volume. A fifth change-over valve 63 is connected at its inlet to the tank section 32 of smaller volume through a line 64. The second pump 59 is connected at its outlet to a line 65 which, in turn, is connected to a line 66. A fourth change-over valve 67 is connected at its inlet to the line 66 and at its outlet to the water side heat exchanger 5 through a line 68. A sixth change-over valve 69 is connected at its inlet to the line 66 and at its outlet to the ancillary heat exchanger 11 through a line 70. A line 71 is connected to the outlet of the water side heat exchanger 5, and a line 72 is connected to the outlet of the ancillary heat exchanger 11. The lines 71 and 72 are connected to a line 73 connected to the tank section 31 of larger volume.

Operation of the air conditioning system of the aforesaid construction will be described. Space cooling and space heating are carried out by operating the water-cooling type heat pump air conditioning unit 10. The water is supplied from the cold and heat accumulating tank 30 to the water side heat exchanger 5 of the water-cooling type heat pump air conditioning unit 10 to effect heat exchange. The water in the cold and heat accumulating tank 30 has its temperature controlled to a suitable level by the heat pump chilling unit 40.

In a cooling mode, the water side heat exchanger 5 of the water-cooling type heat pump air conditioning unit 10 acts as a condenser and the utilization side heat exchanger 15 acts as an evaporator as a result of actuation of the four-way change-over valve 3. Thus, the refrigerant of high pressure and temperature compressed by the compressor 1 flows in the direction of solid line arrows into the water side heat exchanger 5, functioning as a condenser, and gives off heat to a cooling water fed from the cold and heat accumulating tank 30 to change to a liquid state by condensation. The refrigerant of high pressure in the liquid state flows through the line 8 into the pressure reducing means 13 via the check valve 6 and line 9, to be expanded by having its pressure reduced. The refrigerant of low pressure and temperature obtained by expansion and pressure reduction flows through the line 14 to the utilization side heat exchanger 15 functioning as an evaporator to exchange heat with air forcibly supplied by the blower 16 to the space to be cooled, to effect space cooling. Meanwhile the refrigerant absorbs heat from the air and changes to a gaseous state before flowing through the line 17 and via the four-way change-over valve 3 and line 19 to the accumulator 18 where the gas is separated from the liquid and the gas is drawn by suction through the line 20 into the compressor 1, to thereby complete the refrigeration cycle.

In the aforesaid cooling mode, the ancillary heat exchanger 11 remains inoperative. The cooling water supplied to the water side heat exchanger 5, functioning as a condenser is fed by actuating the second pump 59 to draw water from the tank section 31 of larger volume through the line 62, third change-over valve 61 and line 60, before being supplied to the heat exchanger 5 through the lines 65 and 66, fourth change-over valve 67 and line 68. The water heated by heat exchange is returned through the lines 71 and 73 to the tank section 31 of larger volume. However, the water returned to the tank section 31 is led into a chamber separated by the partition wall 33 from the chamber from which the cold water is drawn through the line 62, thereby avoiding mingling of cold water with warm water. In the cooling mode, the fifth and sixth change-over valves 63, 69 remain closed.

Cold water is accumulated in the cold and heat accumulating tank 30 by the action of the heat pump chilling unit 40 which is operated at night by utilizing night electric power so as to accumulate cold water of about 20° C. in the tank section 31 of larger volume suitable for use as condenser cooling water and accumulate cold water of about 5° C. in the tank section 32 of smaller volume. More specifically, the four-way change-over valve 42 of the heat pump chilling unit 40 is actuated to cause the refrigerant passage 46 in the water side heat exchanger 45 to function as an evaporator and to cause the heat source side heat exchanger 43 to function as a condenser. The refrigerant of high pressure and temperature obtained by the compressor 41 is passed through the four-way change-over valve 42, line 47, heat source side heat exchanger 43 and line 47 to the circuit 44 of pressure reducing means where the refrigerant is expanded by having its pressure reduced, before flowing through the line 47, refrigerant passage 46, line 47 and four-way change-over valve 42 to the compressor 41, thereby completing the refrigeration cycle for cooling the water in the water side heat exchanger 5. The blower 49 is in operation during the refrigeration cycle. The water in the tank section 31 of larger volume is circulated by the first pump 50 through the lines 52, 51, water side heat exchanger 45, lines 56, 55, first change-over valve 53 and line 54 constituting a water circulating circuit, to provide cold water of about 20° C. The second change-over valve 57 remains closed during the aforesaid cold water forming operation. When the cold water of about 5° C. is accumulated in the tank section 32 of smaller volume, the first pump 50 is actuated by closing the first change-over valve 53 and opening the second change-over valve 57. When the cold water of about 5° C. is produced by the water side heat exchanger 5, it is necessary to reduce the evaporation temperature of the refrigeration cycle. The end is attained by actuating the timer 48 in switching the evaporation temperatures.

Demand for electric power greatly increases in the summertime and the power supply may fail. When failure of power supply occurs at peak load, for example, operation of the air conditioning unit 10 would be rendered impossible. When this situation occurs, the water-cooling type heat pump air conditioning unit 10 is shut down and the blower 16 is only operated to feed air into the space, and the fifth and sixth change-over valves 63 and 69 are opened and the third and fourth change-over valves 61 and 67 are closed to actuate the second pump 59. The cold water of about 5° C. is accumulated in the tank section 32 of smaller volume and fed to the ancillary heat exchanger 11 through the line 64, fifth change-over valve 63, lines 60, 65, sixth change-over valve 69 and line 70, to cool the air forcibly blown by the blower 16 into the space to thereby continue space cooling. The cold water is returned to the tank section 31 of larger volume through the lines 72 and 73 after cooling the air.

The aforesaid operation may be performed not only when failure of power supply occurs but also when it is desired to economize on power consumption by utilizing night electric power. By performing the aforesaid operation, consumption of power can be minimized because the blower 16 and the second pump 59 only rely on power for operation. The tank section for accumulating the cold water of about 5° C. only has to have a small volume because the cold water is only used to cope with power supply failure at peak load.

In a heating mode, warm water is accumulated in the cold and heat accumulating tank 30 by utilizing night electric power. The warm water in the tank section of larger volume has a temperature of about 35° C. and the warm water in the tank section of smaller volume has a temperature of about 55° C. The water circulating cycle between the cold and heat accumulating tank 30 and the water side heat exchanger 45 of the heat pump chilling unit 40 is the same as that described by referring to production of cold water. The refrigeration cycle of the heat pump chilling unit 40 takes place in reverse as the four-way change-over valve 42 is actuated, so that a refrigerant of high temperature flows through the refrigerant passage 46 to heat the water. The warm water produced by heating the water is led by the first pump 50 to the tank 30 and accumulated in the tank section 31 of larger volume and the tank section 32 of smaller volume. Since the two tank sections differ from each other in the temperature of the water accumulated therein, it is necessary to raise the condensation temperature of the refrigeration cycle of the heat pump chilling unit 40 when warm water of about 55° C. is accumulated in the tank section 32 of smaller volume. The end can be attained by actuating the timer 48.

Generally, in initial stages of heating operations, it takes time to obtain stabilization of the refrigeration cycle and a considerably long time elapses before warm air flows in every nook and cranny of the space to warm the same. Particularly in the early morning a high load makes it necessary to wait a long time before the space is heated sufficiently for the occupants to feel warmth. At this time, the warm water of about 55° C. accumulated in the tank section 32 of smaller volume is directly fed by the second pump 59 to the ancillary heat exchanger 11 to warm the air. The circulation cycle of the warm water is the same as the circulation cycle of the cold water described by referring to the cooling operation. In the air conditioning system shown in FIG. 1, the water-cooling type heat pump air conditioning unit 10 remains inoperative while the heating operation is being performed by feeding the warm water to the ancillary heat exchanger 11 as described hereinabove, but the unit 10 may be rendered operative by alterning the water line circuit. The time of high load in the early morning is relatively short, so that the tank section of smaller volume would be enough. When the space has been warmed to a certain degree, the occupants would not feel uncomfortable until stabilization of the refrigeration cycle is obtained, even if the system is switched to a normal heating operation. A normal heating operation can be performed by actuating the four-way change-over valve 3 of the water-cooling type heat pump air conditioning unit 10 to cause the refrigerant to flow in the direction of arrows in broken lines to form a cycle in reverse of the cycle for the cooling operation. The warm water of about 35° C. accumulated in the tank section 31 of larger volume is fed by the second pump 59 to the water side heat exchanger 5 functioning as an evaporator to allow heat exchange to take place between the warm water and the refrigerant. Thus, the water-cooling type heat pump air conditioning unit 10 of low heating capabilities can be made to achieve satisfactory heating effects in initial stages of heating operation in spite of the equipment being compact in size and light in weight. Moreover, use of the cold and heat accumulating tank 30 enables power cost to be reduced by reducing the power consumption in the daytime.

Figure 2:
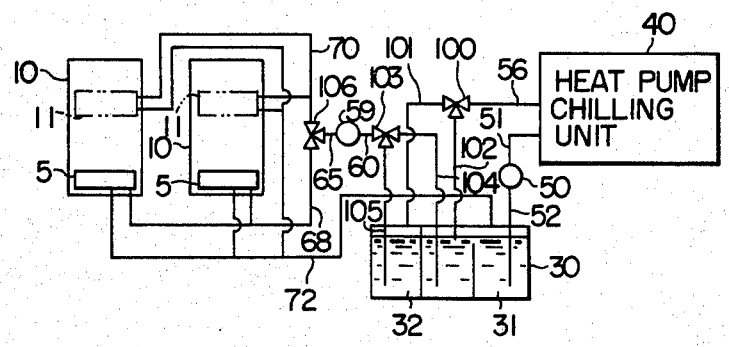
FIG. 2 is a schematic view of the piping of the air conditioning system comprising another embodiment of the invention.

FIG. 2 shows another embodiment in which three-way valves are used as change-over valves. A three-way valve 100 is connected at one connecting port to the tank section 32 of smaller volume through a line 101 and at another connecting port to the tank section 31 of larger volume through a line 102. A three-way valve 103 is connected at one connecting port to the tank section 31 of larger volume through a line 104 and at another connecting port to the tank section 32 of smaller volume through a line 105. A three-way valve 106 is connected at one end to the line 68 and at another end to the line 70, to be connected to the respective water side heat exchangers 5 and the ancillary heat exchangers 11 of the water-cooling type heat pump air conditioning unit 10. The three-way valves 100 and 106 are constructed such that when one outlet is open the other outlet is closed. The three-way valve 103 is constructed such that when one suction port is open the other suction port is closed. The embodiment shown in FIG. 2 has two air conditioning units on the utilization side which are operated in the same manner as described by referring to the embodiment shown in FIG. 1. The embodiment shown in FIG. 2 offers the advantages that the number of the change-over valves used can be reduced and the piping can be simplified.

Figure 3:
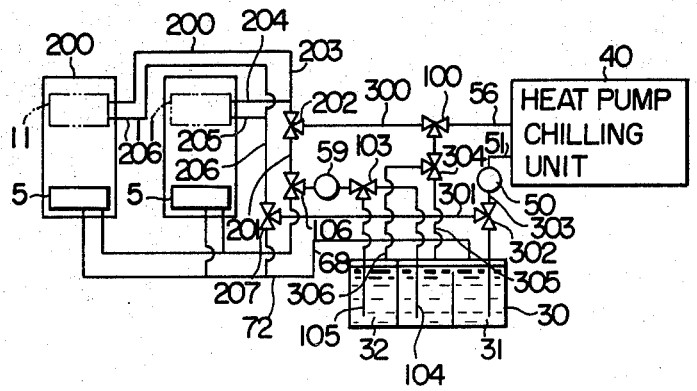
FIG. 3 is a schematic view of the piping of the air conditioning system comprising a further embodiment of the invention.

FIG. 3 shows a further embodiment in which two water-cooling type air conditioning units 200 are connected in parallel with each other. The air conditioning units 200 are not of the heat pump type. When the air conditioning units 200 are actuated to perform space cooling, the water accumulated in the cold and heat accumulating tank 30 is utilized as cooling water for the water side heat exchanger 5 functioning as a condenser, in the same manner as described by referring to FIGS. 1 and 2. More specifically, cold water is fed from the tank section 31 of larger volume to the water side heat exchanger 5 through the line 62, three-way valve 103, second pump 59, three-way valve 106 and line 68, and returned through the line 72 to the tank section 31. When a failure of power supply occurs at peak load, the air conditioning units 200 are shut down and cold water of about 5° C. is drawn by suction by the second pump 59 through the line 105 and three-way valve 103, so that the cold water is supplied via the three-way valve 106, a line 201, a three-way valve 202 and lines 203 and 204 to the ancillary heat exchanger 11, to cool air currents supplied by the blower. The cold water is returned, after use, to the tank section 31 of larger volume through lines 205 and 206 and a three-way valve 107 via the line 72.

In a heating mode, the system is operated at startup in the same manner as the system is operated when power failure occurs in a cooling mode. At this time, warm water of about 55° C. is accumulated in the tank section 32 of smaller volume by the heat pump chilling unit 40.

In a normal heating mode, the warm water accumulated in the tank section 31 of larger volume is fed into the water side heat exchanger 11 to perform space heating. At this time, the warm water flows from the tank section 31 of larger volume through the line 104, three-way valve 103, second pump 59, three-way valve 106, line 201, three-way valve 202, lines 203 and 204, water side heat exchanger 11, lines 205 and 206, three-way valve 207 and line 27, to return to the tank section 31.

It is possible to perform space heating by directly feeding the warm water produced by the heat pump chilling unit 40 to the ancillary heat exchangers 11 of the air conditioning units 200. At this time, the warm water flows from the heat pump chilling unit 40 through the line 56, three-way valve 100, a line 300, three-way valve 202, lines 203 and 204, ancillary heat exchangers 11, lines 205 and 206, three-way valve 207, a line 301, a three-way valve 302, a line 303, first pump 50 and line 51, to return to the heat pump chilling unit 40.

When water is accumulated in the tank section 31 of larger volume and the tank section 32 of smaller volume by actuating the heat pump chilling unit 40, a three-way valve 304 is actuated to cause water to flow into the respective tank sections through lines 305 and 306. The embodiment shown FIG. 3 enables the water-cooling type air conditioning units that have already been installed to operate without any trouble at startup in a heating mode and when power failure occurs at peak load in a cooling mode.

What is claimed is:

1. An air conditioning system comprising:

first line means for connecting a cold and heat accumulating tank to a water side heat exchanger of a chilling unit through a first pump to allow water to flow from a large volume tank section of the accumulating tank into the water side heat exchanger, said cold and heat accumulating tank including a small volume tank section, said small volume tank section and said large volume tank section accommodating water of different temperatures;

second line means for connecting an outlet end of said water side heat exchanger of said chilling unit to said cold and heat accumulating tank for returning to said large volume tank section through a first change-over valve;

third line means for connecting the outlet end of said water side heat exchanger of said chilling unit to said cold and heat accumulating tank for returning water to said small volume tank section through a second change-over valve;

fourth line means for connecting said cold and heat accumulating tank to a water side heat exchanger of a water-cooling type heat pump air conditioning unit to allow water in said large volume tank section to flow to said water side heat exchanger through a third change-over valve, a second pump, and a fourth change-over valve;

fifth line means for connecting an outlet end of said water side heat exchanger of said water-cooling type heat pump air conditioning unit to said cold and heat accumulating tank to return water from said water side heat exchanger to said large volume tank section;

sixth line means for connecting said small volume tank section of said cold and heat accumulating tank to said second pump through a fifth change-over valve; and seventh line means for connecting said second pump to said cold and heat accumulating tank to return water from said second pump to said large volume tank section through a sixth change-over valve and through an ancillary heat exchanger in said water-cooling type heat pump air conditioning unit.

2. An air conditioning system as claimed in claim 1, wherein said large volume tank section of said cold and heat accumulating tank is provided with a partition wall means for enabling an overflow between the tank sections, one of said tank sections is connected to a suction line of said first pump and a return line from said water side heat exchanger of said water-cooling type heat pump air conditioning unit and said ancillary heat exhanger in said air conditioning unit, and the other tank section is connected to said first change-over valve and said third change-over valve.

3. An air conditioning system as claimed in claim 1, wherein the temperature of the water accommodated in said large volume tank section of said cold and heat accumulating tank is about 20° C., and wherein the temperature of the water accommodated in said small volume tank section is about 5° C. in a cooling mode.

4. An air conditioning system as claimed in claim 1, wherein the temperature of the water accommodated in said large volume tank section of said cold and heat accumulating tank is about 35° C., and wherein the temperature of the water accommodated in said small volume tank section is about 55° C.

5. An air conditioning system as claimed in claim 3, wherein, in a cooling mode, the temperature of water accommodated in said large volume tank section of said cold and heat accumulating tank is about 20° C. and is fed to said water side heat exchanger of said water-cooling type heat pump air conditioning unit to carry out cooling in a normal cooling operation, the temperature of the water accommodated in said small volume tank section is about 5° C., a blower means is provided for supplying air currents to a space to be cooled, and wherein, when it is impossible to operate said water-cooling type heat pump air conditioning unit due to at least one of power consumption economization and power failure, only said blower means is operated with the water in said small volume tank section being fed to said ancillary heat exchanger to carry out a cooling operation.

6. An air conditioning system as claimed in claim 4, wherein, in a heating mode, the temperature of the water accommodated in said small volume tank section is about 55° C. and is fed to said ancillary heat exchanger to initiate a start-up operation.

7. An air conditioning system as claimed in claim 4, wherein, in a normal heating operation, the temperature of the water accommodated in said large volume tank section is about 35° C. and is fed to said water side heat exchanger of said water-cooling type heat pump air conditioning unit as cooling water to carry out the heating operation.

8. An air conditioning system comprising:

first line means for connecting a cold and heat accumulating tank to a water side heat exchanger of a chilling unit through a first pump to allow water to flow from a large volume tank section of the accumulating tank into the water side heat exchanger, said cold and heat accumulating tank including a small volume tank section, said small volume tank section and said large volume tank sections accommodating water of different temperatures;

second line means for connecting an outlet end of said water side heat exchanger of said chilling unit to said cold and heat accumulating tank for returning water to said large volume tank section through a first three-way change-over valve;

third line means for connecting the outlet end of said water side heat exchanger of said chilling unit to said cold and heat accumulating tank for returning water to said small volume tank section through another connecting port of said first three-way change-over valves;

fourth line means for connecting said cold and heat accumulating tank to a water side heat exchanger of a water-cooling type heat pump air conditioning unit for allowing water to flow from said large volume tank section to said water side heat exchanger through a fourth three-way change-over valve, a second pump, and a fifth three-way change-over valve;

fifth line means for connecting an outlet end of said water side heat exchanger of said water-cooling type heat pump air conditioning unit to said cold and heat accumulating tank for returning water to said large volume tank section;

sixth means for connecting the small volume tank section of said cold and heat accumulating tank to another connecting port of said fourth three-way change-over valve; and seventh line means for connecting another connecting port of said fifth three-way change-over valve to said large volume tank section of said cold and heat accumulating tank through and ancillary heat exchanger in said water-cooling type heat pump air conditioning unit.

9. An air conditioning system as claimed in claim 8, wherein said large volume tank section of said cold and heat accumulating tank is provided with a partition means for enabling an overflow between the tank sections, one of said tank sections is connected to a suction line of the first pump and to return lines from said water side heat exchanger of said water-cooling type heat pump air conditioning unit and said ancillary heat exchanger in said air conditioning unit, and the other tank section is connected to lines from said first three-way change-over valve and said fourth three-way change-over valve.

10. An air conditioning system as claimed in claim 8, wherein the temperature of the water accommodated in said large volume tank section of said cold and heat accumulating tank is about 20° C., and wherein the temperature of the water accommodated in said small volume tank section is about 5° C. in a cooling mode.

11. An air conditioning system as claimed in claim 8, wherein, in a cooling mode, the temperature of the water accommodated in said large volume tank section of said cold and heat accumulating tank is about 20° C. and is fed to said water side heat exchanger of said water-cooling type heat pump air conditioning unit to carry out cooling in a normal cooling operation, the temperature of the water accommodated in the small volume tank section is about 5° C., a blower means is provided for supplying air currents to a space to be cooled, and wherein, when it is impossible to operate said water-cooling type heat pump air conditioning unit due to at least one of power consumption economization and power failure, only said blower means is operated with the water in said small volume tank section being fed to said ancillary heat exchanger to carry out a cooling operation.

12. An air conditioning system as claimed in claim 8, wherein, in a heating mode, the temperature of the water accommodated in said small volume tank section is about 55° C. and is fed to said ancillary heat exchanger to initiate a startup operation.

13. An air conditioning system as claimed in claim 8, wherein the temperature of the water accommodated in said large volume tank section of said cold and heat accumulating tank is about 35° C., and wherein the temperature of the water accommodated in said small volume tank section is about 55° C. in a heating mode.

14. An air conditioning system as claimed in claim 13, wherein, in a normal heating operation, the temperature of the water accommodated in said large volume tank section is about 35° C. and is feed to said water side heat exchanger of said water-cooling type heat pump air conditioning unit as cooling water to carry out the heating operation.

15. An air conditioning system comprising:

first line means for connecting a cold and heat accumulating tank to a water side heat exchanger of a chilling unit through a first three-way change-over valve and a first pump for allowing water to flow from a large volume tank section into the water side heat exchanger, said cold and heat accumulating tank including a small volume tank section, said small volume tank section and said large volume tank section accommodating water of different temperatures;

second line means for connecting an outlet end of said water side heat exchanger of said chilling unit to said cold and heat accumulating tank to return water to said large volume tank section through a second three-way change-over valve and a third three-way change-over valve;

third line means for connecting a connecting port of said third three-way change-over valve to said cold and heat accumulating tank for returning water to said small volume tank section;

fourth line means for connecting said cold and heat accumulating tank to condenser means of water-cooling type air conditioning units for allowing water in said large volume tank section to flow into said condenser means through a fourth three-way change-over valve, a second pump and a fifth three-way change-over valve;

fifth line means for connecting an outlet end of said condenser means to said cold and heat accumulating tank for returning water to said large volume tank section;

sixth line means for connecting said small volume tank section to said second pump through a connecting port of said fifth three-way change-over valve; and seventh line means for connecting another connecting port of said fifth three-way change-over valve to a sixth three-way change-over valve and for connecting a connecting port of said second three-way change-over valve to said first three-way change-over valve through said sixth three-way change-over valve, ancillary heat exchangers in said water-cooling type air conditioning units, and a seventh three-way change-over valve.

16. An air conditioning system as claimed in claim 15, wherein said large volume tank section of said cold and heat accumulating tank is provided with a partition means for enabling an overflow between the tank sections, one of said tank sections is connected to a line of said first three-way change-over valve and return lines from said condenser means and said ancillary heat exchangers in said water-cooling type air conditioning units, and the other tank section being connected to a line from said third three-way change-over valve and said fourth three-way change-over valve.

17. An air conditioning system as claimed in claim 15, wherein the temperature of the water accommodated in said large volume tank section of said cold and heat accumulating tank is about 20° C., and wherein the temperature of the water accommodated in said small volume tank section is about 5° C. in a cooling mode.

18. An air conditioning system as claimed in claim 15, wherein, in a cooling mode, the temperature of the water accommodated in said large volume tank section of said cold and heat accumulating tank is about 20° C. and is fed to said water side heat exchangers of said water-cooling type air conditioning units to carry out cooling in a normal cooling operation, the temperature of water accommodated in the small volume tank section is about 5° C., a blower means is provided for supplying air currents to a space to be cooled, and wherein, when it is impossible to operate said water-cooling type heat pump air conditioning units due to at least one of power consumption economization and power failure, only said blower means is operated with the water in said small volume tank section being fed to said ancillary heat exchanger to carry out a cooling operation.

19. An air conditioning system as claimed in claim 15, wherein, in a normal heating operation, warm water is fed directly from the chilling unit to said ancillary heat exchangers in said water-cooling type air conditioning units to perform the heating operation.

20. An air conditioning system as claimed in claim 15, wherein the temperature of the water accommodated in said large volume tank section of said cold and heat accumulating tank is about 30° C., and wherein the temperature of the water accommodated in said small volume tank section is about 55° C. in a heating mode.

21. An air conditioning system as claimed in claim 20, wherein, in a heating mode, the temperature of the water accommodated in said small volume tank section is about 55° C. and is fed to said ancillary heat exchangers to initiate a startup operation.

22. An air conditioning system as claimed in claim 20, wherein, in a normal heating operation, the temperature of the water accommodated in said large volume tank section is about 35° C. and is fed to the water side heat exchangers of said air-cooling type air conditioning units by merely causing said water to flow through said water side heat exchanger while keeping said chilling unit inoperative, to carry out the heating operation.

* * * * *